United States Patent [19]

Mentzer et al.

[11] 4,433,515

[45] Feb. 28, 1984

[54] REMOTELY OPERABLE LATCH AND LOCKING PIN FOR A MULTI-SECTION BOOM INCLUDING A MANUAL FLY SECTION

[75] Inventors: William R. Mentzer, Shady Grove; Vincent Bernabe, Jr., Newville, both of Pa.

[73] Assignee: Kidde, Inc., Saddle Brook, N.J.

[21] Appl. No.: 318,039

[22] Filed: Nov. 4, 1981

[51] Int. Cl.[3] ..... B66C 23/06

[52] U.S. Cl. ..... 52/115; 52/632; 212/268

[58] Field of Search ..... 52/115, 118, 632; 212/230, 264, 268

[56] References Cited

U.S. PATENT DOCUMENTS

| | | | |
|---|---|---|---|
| 3,346,281 | 10/1967 | Thompson | 52/115 X |
| 3,842,985 | 10/1974 | Svede | 212/264 |
| 3,921,819 | 11/1975 | Spain | 212/268 |

*Primary Examiner*—Carl D. Friedman

*Attorney, Agent, or Firm*—Brady, O'Boyle & Gates

[57] ABSTRACT

A multi-section hydraulically operated telescoping crane boom includes a manual fly section which may be safely extended and retracted, securely latched in the extended position and pin locked by remote operation of a biased hydraulically powered latching plunger and a biased cooperative hydraulically powered locking pin both embodied in a static pressure hydraulic circuit which includes a pressure-responsive indicator to indicate when the latching plunger is engaged. The circuit also includes safety interlocks for the cooperative latching plunger and locking pin preventing their operation in improper sequence.

12 Claims, 11 Drawing Figures

REMOTELY OPERABLE LATCH AND LOCKING PIN FOR A MULTI-SECTION BOOM INCLUDING A MANUAL FLY SECTION

BACKGROUND OF THE INVENTION

Prior U.S. Pat. No. 3,921,819 discloses a latching and pin locking mechanism for multi-section telescoping booms which enables the safe operation of the boom fly section without the necessity for extending hydraulic lines and electrical control cables forwardly in the boom structure to the locations of the latch plunger and locking pins or to points near these locations, thus rendering the use of the fly section much more economical and practical.

However, in the noted prior patent, a serious drawback exists in that the latching and pinning mechanism can only be operated when the boom is in a horizontal, or substantially horizontal, position so that a human operator can have access to controls for the latching plunger and locking pin. This is a serious disadvantage when the crane must be operated in close quarters, such as in an oil refinery where available space is very limited.

Accordingly, it is the major object of this invention to improve significantly on the arrangement in the noted prior patent through provision of a remotely operated hydraulic power system through which the cooperative latching plunger and locking pin means can be conveniently operated regardless of the elevation or angle of the crane boom, therefore greatly expanding the entire range of utility of the crane and the latch and locking pin arrangement which forms the heart of the invention.

Another very important aspect of the invention is the provision within the hydraulic control circuit for the latching plunger and locking pin means of a safety interlock arrangement which renders it impossible for these two components to be operated in improper sequence which otherwise could allow the fly section to be unsupported causing its sudden collapse.

The present invention continues to include the advantage that hydraulic lines and/or electrical lines do not have to be extended forwardly into the fly section of the boom to effect operation of the latching plunger and locking pin from a remote point. Therefore, the basic economies and simplicity achieved in prior U.S. Pat. No. 3,921,819 are retained but without the restriction that the system can only be operated while the boom is in a horizontal position.

Other features and advantages of the invention will become apparent from the specification hereinafter following by reference to the accompanying drawings.

DETAILED DESCRIPTION OF THE PREFERRED EMBODIMENT

Figure 1:
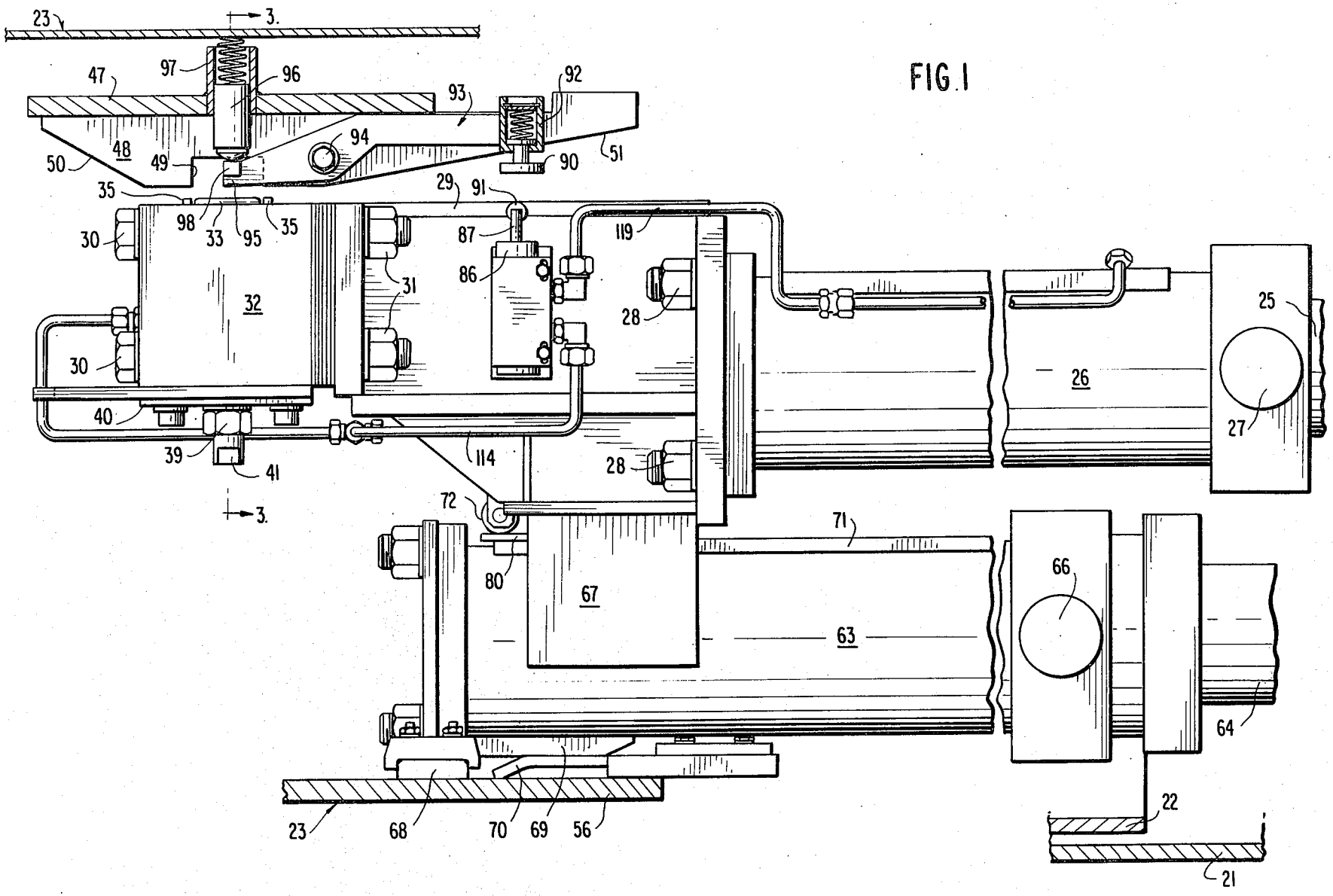
FIG. 1 is an enlarged fragmentary side elevation, partly in vertical section, taken through a multi-section crane boom having the remotely operable latch plunger and locking pin means according to the invention.

Referring to the drawings in detail wherein like numerals designate like parts, a multi-section telescoping crane boom is shown having a base section 20, inner and outer midsections 21 and 22 and manual fly section 23. As used herein, the term "manual" refers to a fly section which is not directly powered by an individual hydraulic cylinder and which is not extended and retracted by cables or the like connected with another movable section so as to be simultaneously extended and retracted by the hydraulic cylinders of other movable boom sections. As will be seen, the manual fly section 23 is operated entirely by utilization of the remotely controlled latching and pinning means forming the main subject matter of this invention. It should also be understood that the invention is not limited in its application to a four-section boom which has been illustrated for convenience, and can be used on booms having three sections, five sections, or any practical number of telescoping sections.

Continuing to refer to the drawings, the boom base section 20 near its interior end has coupled thereto at 24 the piston rod 25 of a first hydraulic cylinder 26 having its rear end pivotally connected at 27 to the rearward end of boom inner mid-section 21.

Figure 2:
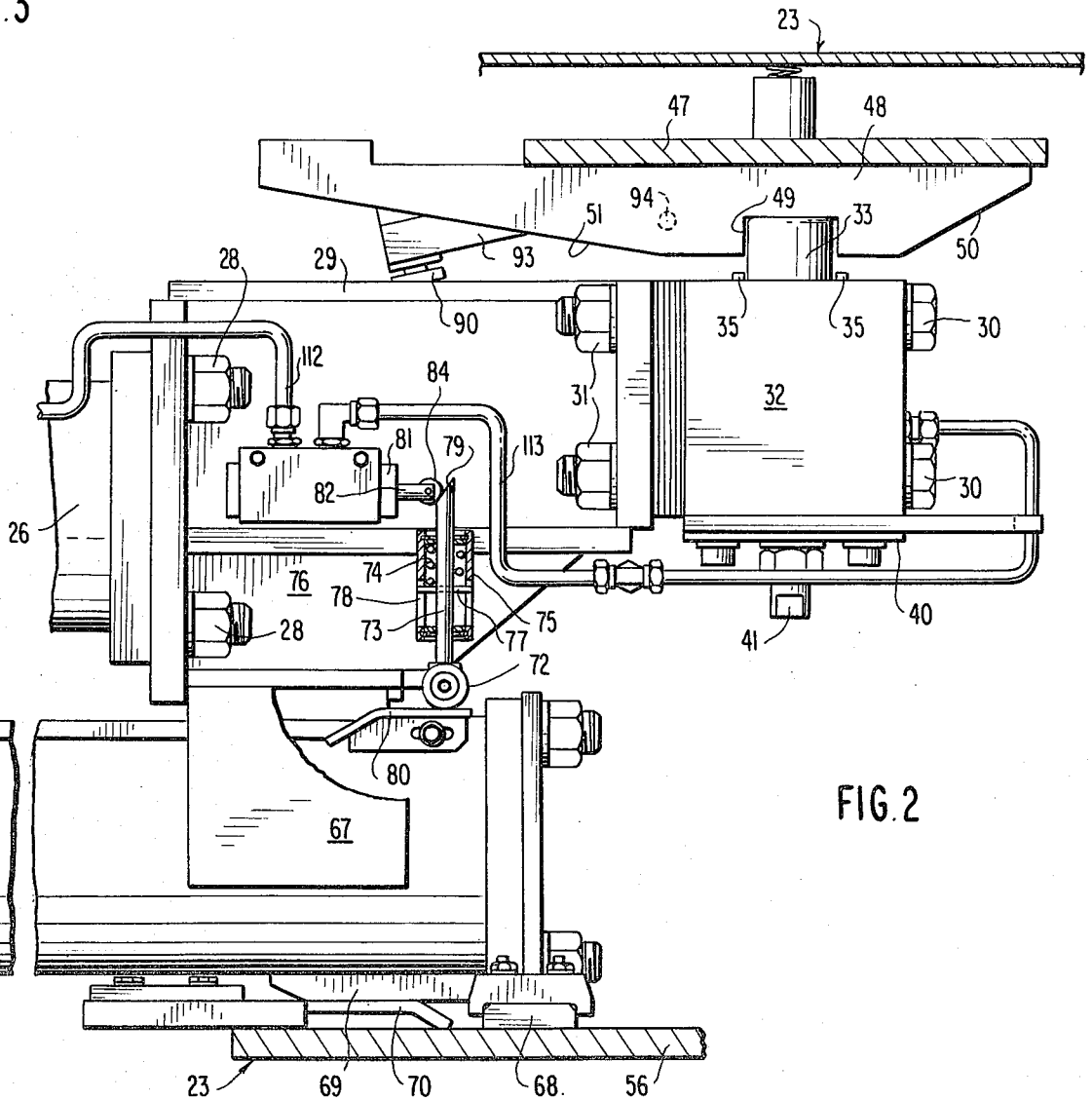
FIG. 2 is a fragmentary side elevation similar to FIG. 1 viewing the opposite side of the mechanism and showing parts thereof in different operative positions compared to FIG. 1.

At its forward end, FIGS. 1 and 2, the cylinder 26 is rigidly coupled at 28 to an extension 29 or body portion which projects forwardly of cylinder 26 and into the boom fly section 23 when the latter is fully retracted or partly retracted relative to base section 20 and cylinder 26. At its forward end, the extension 29 is further rigidly connected by four bolts 30 carrying nuts 31 with a housing 32 for a latching plunger 33 disposed movably within a bore 34 of the housing 32 and held against rotation therein by a pair of side stops 35 on the housing engaging flats on the latching plunger 33.

Figure 3:
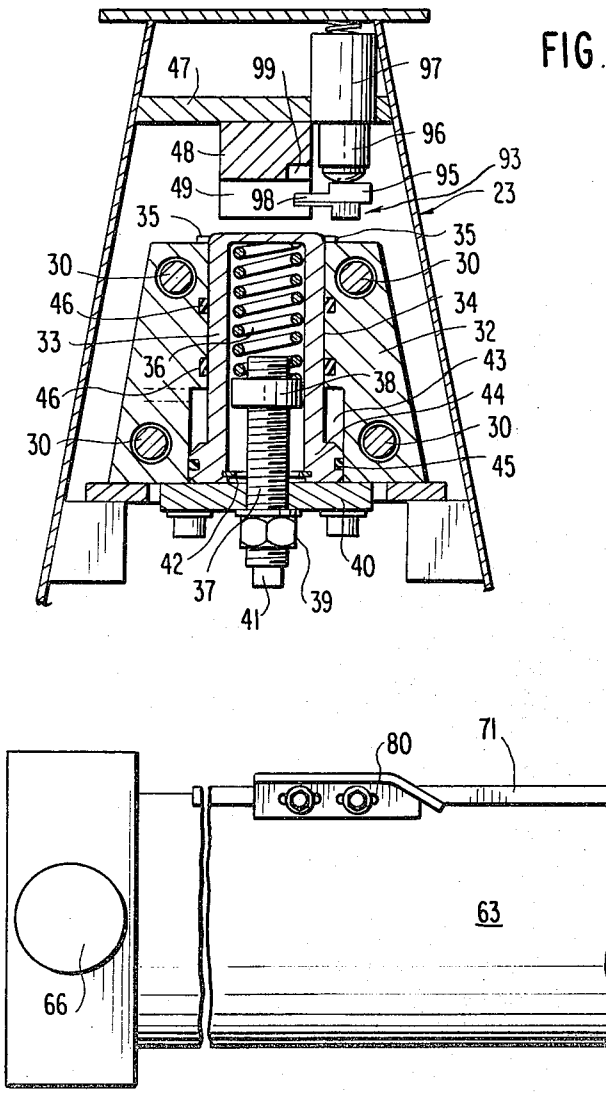
FIG. 3 is a transverse vertical section taken substantially on line 3—3 of FIG. 1.

The latching plunger 33 is biased outwardly from the housing 32 toward its engaging position shown in FIG. 2 by an internal compression spring 36, the retracted position of the latching plunger being illustrated in FIGS. 1 and 3. The tension of the spring 36 can be regulated by an adjusting screw 37 having a shoulder 38 inside of the hollow latching plunger 33 on which one end of the spring 36 is seated. The adjusting screw 37 having a locking nut 39 thereon below bottom plate 40 of the housing 32 in which it is threaded can also be operated in an emergency as where there is a loss of hydraulic power to retract the latching plunger 33. For this purpose the screw 37 has a wrench extension 41 below the nut 39 which after loosening of the nut can be turned to bring the should 38 downwardly into contact with a locking ring 42 fixed in the plunger 33.

Further turning of the screw 37 following contact of the shoulder 38 with locking ring 42 will retract the latching plunger 33 into the housing 32. Normally, the plunger is retracted by hydraulic fluid pressure supplied to a chamber 43 of housing 32 and acting on an enlarged head 44 of the latching plunger, which head carries a seal 45. Additional seals 46 for the latching plunger 33 are provided in spaced relation along the bore 34, as shown.

At its rear end, fly section 23 on the bottom of an interior web 47 carries a fixed depending latch bar 48 including a latching notch 49 which receives latching plunger 33 when the latter is extended upwardly by spring 36 and sloping forward and rear cam-like end faces 50 and 51.

A cooperative locking pin 52 for the fly section 23 in the extended use position is held in a housing 53 fixed to the bottom of the boom outer mid-section 22 near its forward end. The locking pin 52 is biased outwardly from the housing 53 toward an active locking position by spring means 54 and carries at its outer end a low friction roller 55 adapted to engage the bottom wall 56 of fly section 23 when the latter is extended or retracted relative to the outer mid-section 22. Near its rear end, the bottom wall of fly section 23 has an opening 57 adapted to receive the locking pin 52 at proper times to safely lock the fly section 23 extended relative to the outer mid-section 22 and the other telescoping sections of the boom. The locking pin 52 is retracted below the wall 56 and opening 57 at proper times by the operation of a bell crank 58 pivotally mounted at 59, FIG. 4, on a part of the housing 53, which in turn is a part of the usual collar and wear pad housing structure underlying the forward end portion of outer mid-section 22. An arm 60 of bell crank 58 projects into a slot 61 in the bottom of locking pin 52 spanned by a cross pin 62 upon which the arm 60 bears at proper times to retract the locking pin 52, out of engagement with the opening 57. The cooperative action of latching plunger 33 and locking pin 52 according to the major aspect of the invention involving a safety hydraulic interlock feature will be fully described.

A second hydraulic cylinder 63 has its rod 64 coupled at 65 to the rear of boom inner mid-section 21. The rear of cylinder 63 is pivotally attached at 66 to the rear of outer mid-section 22. The cylinder 63 underlies the cylinder 26 as shown in the drawings.

Depending bearing pad supports 67 on the bottom of extension 29 straddle the relatively movable cylinder 63 to stabilize the cantilevered end of cylinder 26. A wear pad 68 at the leading end of cylinder 63 slides on the inner surface of bottom wall 56 of fly section 23. A ramp plate 69 on the bottom of cylinder 63 near its forward end can engage an underlying ramp plate 70 on fly section bottom wall 56 at the rear end of the fly section when the latter is extended to maintain precisely the contact of roller 72 of plunger 73 on elevating cams 80, to be described, during extension of the boom.

The top of cylinder 63 carries a support member 71 for longitudinally adjustable fixed elevating cams 80 connected thereto near opposite ends of the cylinder 63, for the roller 72 of an upstanding plunger 73 biased downwardly by a spring 74 within a housing 75 fixed to a side wall portion 76 of the extension 29. A cross pin 77 for the plunger 73 is guided by slots 78 in the housing 75, as shown in FIG. 2 to prevent rotation of the plunger. The reciprocation of the plunger 73 is guided by the opposite end wall means of the housing 75 which provide a bore for the plunger. The upper end face 79 of plunger 73 is steeply beveled to provide a cam face whose function will be described.

Figure 5A:
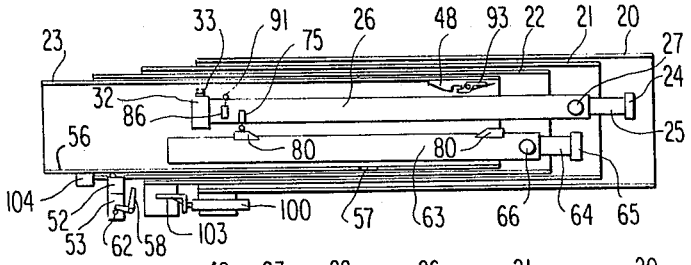
FIGS. 5A through 6B are a sequence of partly schematic side elevational views depicting the operational cycle of the invention.
Figure 5B:
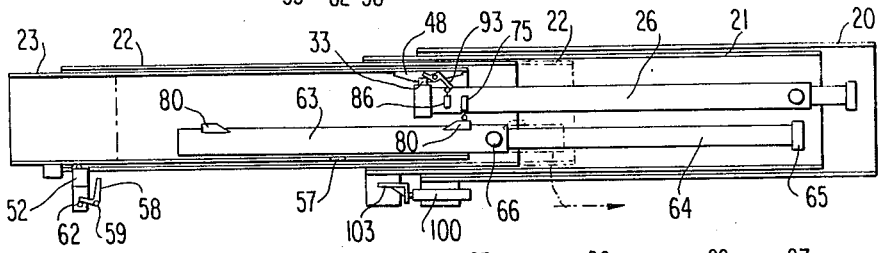

When the cylinder 63 is extended or retracted, FIGS. 5B or 5A, one of the cams 80 passes beneath the roller 72 of plunger 73 to elevate it. Between the two cams 80, the roller 72 and plunger 73 are downwardly biased by spring 74 to a constant lower elevation, fully extended from housing 75.

Figure 4:
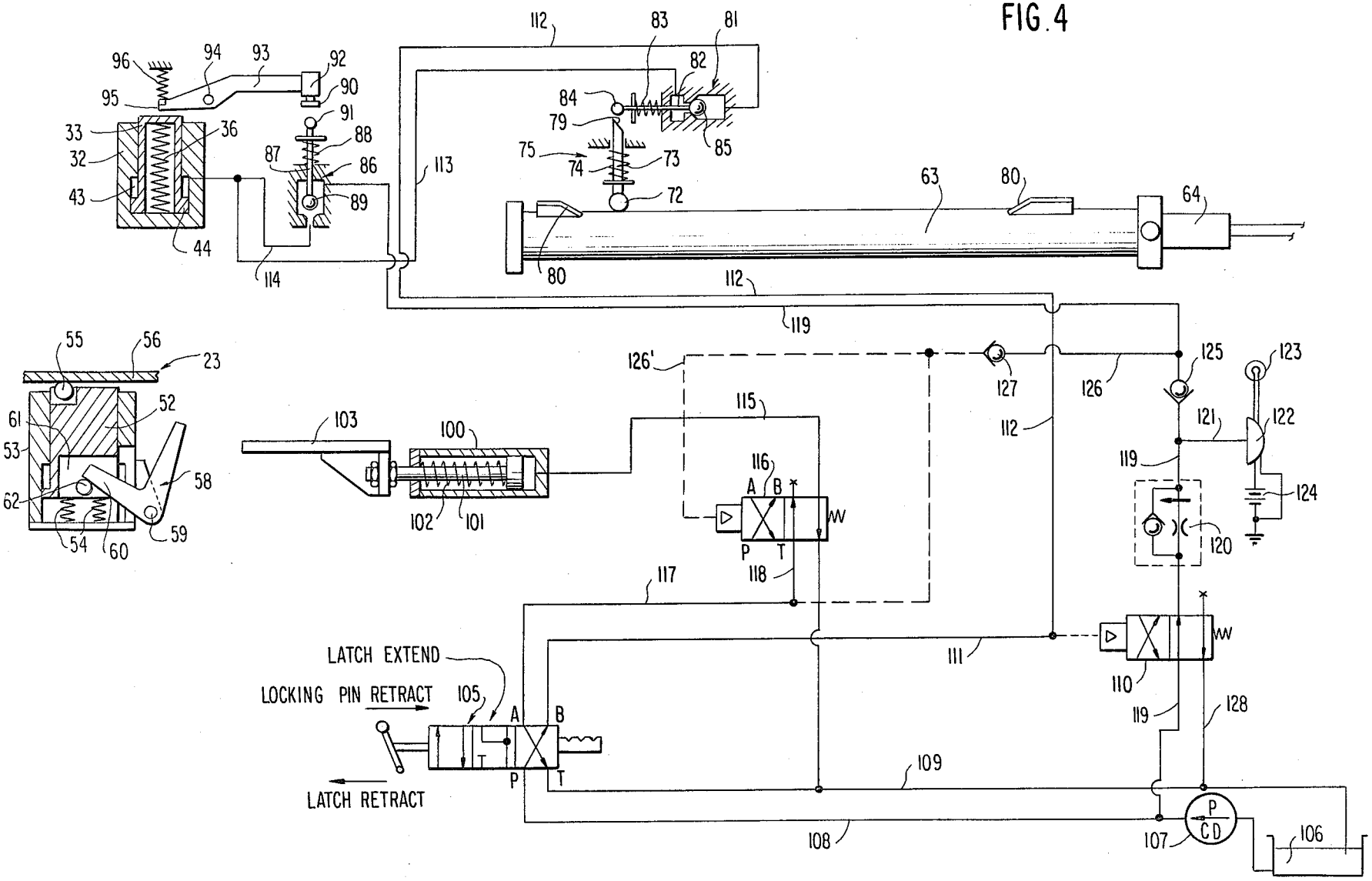
FIG. 4 is a schematic view showing the latching plunger and locking pin for the boom fly section and also showing the hydraulic control circuit for these components including indicator means.

Fixed to the same side of extension 29, FIG. 2, is a horizontal axis check valve 81 whose stem 82 is biased by a spring 83, FIG. 4, toward the right angular plunger 73. A contact roller 84 on one end of the plunger 73 is engaged by the inclined cam surface 79 of plunger 73 when the latter is forced upwardly by one of the cams 80 to the position shown in FIG. 2. This forces the valve plunger 73 inwardly or to the right in FIG. 4 to unseat a valve head 85 which is held normally seated or closed by the spring 83 when the plunger 73 is down under influence of its spring 74 and out of contact with the roller 84 as shown in FIG. 4.

On the opposite side of extension 29, FIG. 1, is fixedly mounted an upright axis valve 86 whose stem 87 is at right angles to the stem 82 and is biased outwardly from its housing by a spring 88 to cause opening or unseating of a valve head 89, as shown in FIG. 4. The valve 86 is normally open as indicated in FIG. 4 but can be closed by the descent of a spring-urged contact element 90 into engagement with a contact head 91, such as a roller, on the outer end of stem 87. The contact element 90 is held within a small housing 92 fixed to one side of a lever 93, rockably mounted at 94 to the latch bar 48 of boom fly section 23. The forward tip 95 of lever 93 is biased downwardly by a spring-urged plunger 96 guided by a sleeve 97 secured within an opening provided in the web 47 of fly section 23. The lever 93 is located close to one side of latch bar 48, FIG. 3, as is the plunger 96. When the latching plunger 33 is extended to enter the notch 49 of latch bar 48, it will engage a small lateral extension or pin 98 on one side of the lever 93 which is within the notch 49, FIG. 3, and will force the extension 98 upwardly into a cavity 99 provided in one side of the latch bar 48 immediately above the notch 49. Therefore, when latching plunger 33 is extended into the notch 49, the lever 93 will be turned upon its pivot 94, clockwise in FIG. 1, the plunger 96 will yield, and the spring-loaded contact element 90 will descend engaging the element 91 and depressing stem 87 of valve 86 to seat the valve head 89 and close the valve which is normally open, as shown in FIG. 4.

A locking pin retract cylinder 100 is fixed to the bottom wall of boom base section 20 at the forward end of the latter and has a piston rod 101 biased inwardly by a spring 102. The piston rod 101 which is extended by fluid pressure carries a rigid actuator 103 for the bell crank 58 which is in its path. It should be noted that the fly section 23 near its forward end carries a fixed stop 104 which engages the forward end of outer mid-section 22 to limit retraction of the fly section into the outer mid-section of the boom.

Referring primarily to FIG. 4, the hydraulic control system forming another important feature of the invention includes a three-position valve 105 having an operating handle in ready reach of the crane operator. This valve is shown in the normal operating position which is the position to cause pulling or retraction of the latching plunger 33 away from the latch bar 48. The intermediate position of the valve 105 is the latch plunger extend position, and the third position of the valve is the locking pin retract position.

Hydraulic fluid from a reservoir 106 is supplied by a constant displacement pump 107 and supply line 108 to the three position valve 105. A fluid return line 109 leads from the valve 105 back to the reservoir 106. A pressure operated dump valve 110 is connected with the control valve 105 by a hydraulic line 111, a pressure build up in this line at times causing the valve 110 to dump fluid into the reservoir 106. Another line 112 connected to the line 111 delivers fluid to the normally closed valve 81. When this valve is opened by the action of plunger 73, fluid is supplied through a line 113 to the chamber 43 of housing 32 to act on the head 44 of latching plunger 33 to retract such plunger. Another line 114 connected with chamber 43 and line 113 delivers fluid at proper times to normally open valve 86 whose stem 87 is operated by the pivoted lever 93, in turn operated by latching plunger 33.

Another hydraulic line 115 connected to the chamber of locking pin retract cylinder 100 delivers fluid through a pressure operated spool valve 116 to the return line 109 leading back to the reservoir 106 when valve 116 is in the normal unactuated position shown. Another line 117 leads from the control valve 105 to the pressure-operated valve 116 via a line 118 to deliver fluid to the chamber of locking pin retract cylinder 100 to extend piston rod 101 and retract locking pin 52 when valve 116 is in its pressure operated position.

Another hydraulic line 119 connected with the supply line 108 leads through pressure-operated dump valve 110 and through a restrictor valve 120 having a built-in, one-way bypass check valve. Beyond the restrictor valve 120 the line 119 is connected to a hydraulic line 121 leading to a normally open pressure switch 122 controlling the operation of an indicator light 123 powered by a source of electrical power 124. A check valve 125 is placed in the line 119 beyond the line 121 and another line 126 for fluid having a check valve 127 therein leads to the pressure-operated valve 116, as shown. The hydraulic line 117 intersects the line 126 between the check valve 127 and pressure-operated valve 116. The hydraulic line 119 terminates in the chamber of normally open valve 86. A fluid line 128 is connected between the valve 110 and return line 109.

OPERATION

The operation of the invention can best be understood by reference to drawing FIGS. 5A through 6B taken with schematic FIG. 4.

Referring to FIG. 5A in which the telescopic boom has all of its sections retracted and being held in the relative positions shown by the two cylinders 26 and 63, the latch plunger 33 has been retracted and the locking pin 52 is biased forwardly and has its roller 55 riding on the lower face of the bottom wall 56 of fly section 23. This is the normal operating condition of the crane boom with the latch plunger 33 powered down in retracted position. For roadway travel the fly section 23 is pinned in the retracted position of FIG. 5A by a manually placed locking pin, not shown, on one side of the boom structure between the fly section and outer mid-section. The stem 87 of valve 86 is now elevated by spring 88, as shown in FIG. 4.

When the telescoping boom is in the described retracted condition shown in FIG. 5A and the valve 105 is in the normal operating position for retracting latch plunger 33, as shown, fluid pressure through the control valve from P to B is delivered through lines 111 and 112 to the chamber of check valve 81, which is normally closed except at the extreme ends of travel of the outer mid-section 22 under influence of cylinder 63 having the elevating cams 80.

If either cam 80 is engaged with plunger 73 to lift the latter, as shown in FIG. 5A, valve 81 opens and pressure through the valve 81 and line 113 to chamber 43 acting on head 44 causes retraction of latching plunger 33 and therefore opening of check valve 86 under influence of its spring 88. However, the two check valves 125 and 127 are closed and therefore pressure continues to build up in line 119 and also through line 113 which is connected to line 119 through the open valve 86 and line 114. Since valve 81 is open, the build up of pressure in line 113 similarly pressurizes line 112 and shifts dump valve 110 to the right so as to return the fluid in line 119 below check valve 125 to the reservoir 106. This dumping of fluid extinguishes the latch plunger engage indicator light 123.

Control valve 105 is then moved to the intermediate or latch extend position. This allows the latch plunger 33 to extend to the dotted line position in FIG. 5A under pressure of spring 36. In this position hydraulic pressure in line 108 is blocked at port P of the control valve and ports A and B are connected to T and return line 109 to the reservoir 106. Return spring 36 forces hydraulic fluid from chamber 43 of the latch, through line 113, check valve 81, line 112 to B, through control valve 105 to T and line 109 to the reservoir. With the latch plunger 33 up, check valve 86 is still open under pressure of its spring 88. Hydraulic pressure from supply line 108 through line 119, dump valve 110, restriction valve 120, check valve 125, line 119 passes through open valve 86 and is returned via lines 114 and 113, check valve 81, lines 112 and 111, B to T to fluid return line 109. Therefore, light 123 does not come on.

Hydraulic cylinder 63 is then extended to extend fly section 23 and outer mid-section 22 as a unit from inner mid-section 21 as shown in FIG. 5B. At the end of the extension operation the extended latch plunger 33 will automatically ride over inclined surface 50 of latch bar 48 and drop into the locking notch 49, thereby rotating lever 93 and closing check valve 86.

As previously indicated pressure is present in the line 119 from supply line 108 and valve 110 and through check valve 125 which will open responsive to this pressure. However, pressure is now blocked by the closed valve 86 and check valve 127 which remains closed. Therefore, the same pressure will exist on both sides of the check valve 125 and wll build up causing normally open pressure switch 122 to close, energizing indicator light 123, thus indicating latch plunger 33 is engaged in notch 49.

Figure 5C:
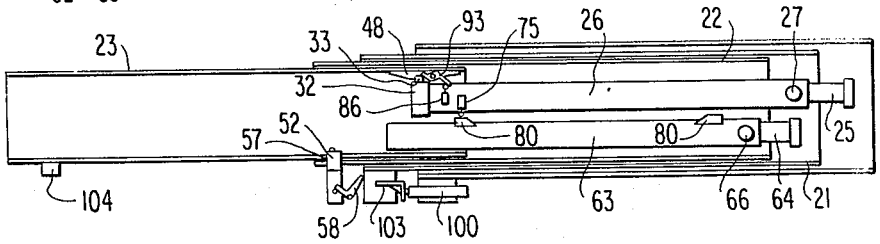

As indicated in phantom line in FIG. 5B cylinder 63 is retracted as shown in FIG. 5C of the drawings, to cause similar retraction of outer mid-section 22 to its position shown in FIG. 5A while fly section 23 remains extended due to the engagement of latching plunger 33 in the notch 49 of latch bar 48. During the retraction of outer mid-section 22, the locking pin 52 which is bodily carried by the outer mid-section has its roller 55 rolling inwardly along the bottom wall of fly section 23 and eventually entering the locking opening 57 adjacent the inner end of the fly section under influence of springs 54. The fly section 23 is now extended from the outer mid-section 22.

Figure 5D:
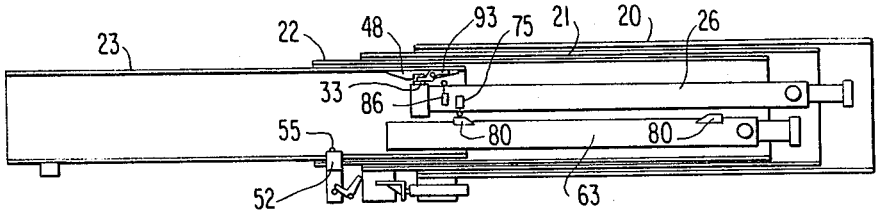

At this point, referring to FIG. 5D, control valve 105 is moved to the latch retract or normal operation position, which is the position illustrated in FIG. 4. Latching plunger 33 is retracted from the latch bar 48 and the indicator light 123 will go out in accordance with the foregoing description. Valve 86 is now open. Valve 81 is open since plunger 73 is engaged by one of the cams 80.

Figure 5E:
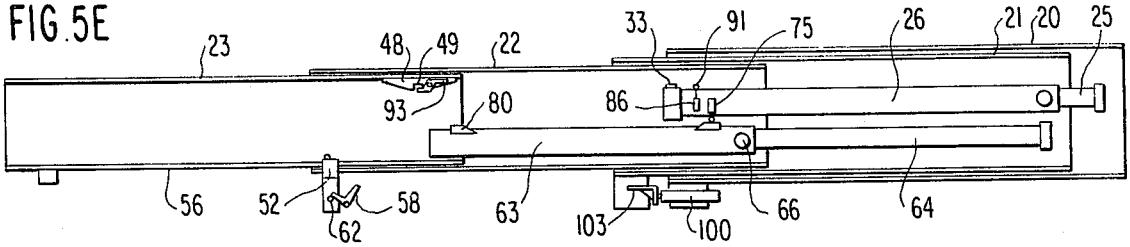

In FIG. 5E, the cylinder 63 is again extended to extend boom outer mid-section 22, and fly section 23 locked to outer mid-section 22 by engaged locking pin 52, will also be extended therewith. As cylinder 63 is extended Valve 81 closes. Thus, FIG. 5E shows the fully extended condition of the telescoping boom except that cylinder 26 can also be extended to advance the inner mid-section 21, if desired.

The two check valves 125 and 127 cause the latching plunger 33 to remain retracted at this time because they trap pressure in the line 119 and through the open valve 86 to the chamber 43. When valve 81 moves from open position to closed position to open position as the cylinder 63 moves one cam 80 beneath plunger 73 and then moves the other cam 80 beneath the actuator at the fully extended position, pressure remains trapped in the lines to keep the latching plunger 33 retracted.

Figure 6A:
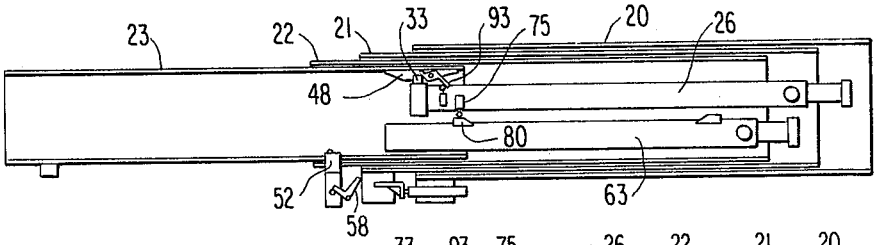
Figure 6B:
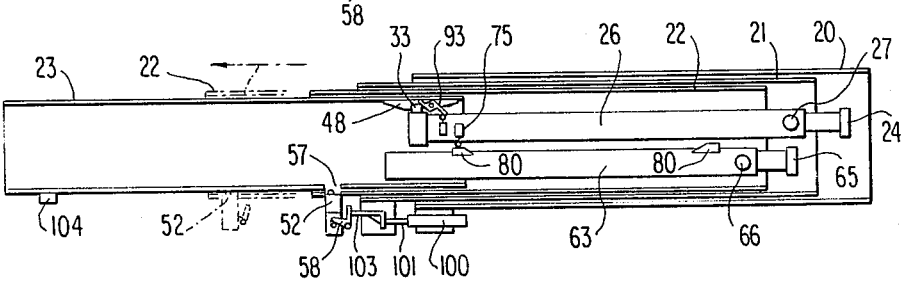

FIGS. 6A and 6B illustrate the steps of retracting the boom back through the condition shown in FIG. 5B and finally to the condition of FIG. 5A.

Starting at FIG. 5E, at the start of the retraction of the fly section 23, the control valve 105 is moved to the middle or latch extend position so that pressure from the supply line 108 is blocked at the valve. Pressurized hydraulic fluid can now leak from chamber 43 causing extension of latching plunger 33. The fluid from chamber 43 will bleed through line 113 and check valve 81 and then through line 112 and line 111 and through the valve 105 in the middle position B to T back to the reservoir 106. Cylinder 63 is retracted to retract outer mid-section 22 to the position shown in FIG. 6A, during which extended latching plunger 33 automatically rides over the inclined surface 51 of the latch bar 48 and drops into the locking notch 49 at the rear of the fly section. This rotates lever 93 and closes check valve 86 causing indicator light 123 to come on utilizing the valve 110 as positioned in FIG. 4 to cause pressure build up in lines 119 and 121 to close switch 122. The light 123 thus indicates that the latching plunger 33 is engaged with the fly section 23.

Referring to FIG. 6B where the indicator light 123 is on, the following occurs. The valve 105 is shifted for the first time in the operation to the extreme right in FIG. 4 which is the locking pin retract position. Pressure from the supply line 108 goes through the valve 105 from P to A and then through line 117 through check valve 127 and on through lines 126 and 119 to valve 86 which is closed since the latching plunger 33 is extended or engaged. This causes a build up of pressure through lines 119 and 126 and in line 126' leading to pressure operated valve 116 which is shifted to the right by the built up pressure connected pressure from line 118 through the valve 116 from P to B, and through line 115 to produce extension of the piston rod 101 of locking pin retract cylinder 100. Extension of rod 101 moves actuator 103 against bell crank 58 turning it counterclockwise, FIG. 4, thereby retracting locking pin 52 from the opening 57 in the rear of fly section 23, so that the outer mid-section 22 can be extended forwardly over the latched fly section 23, as shown in broken lines in FIG. 6B, by extending cylinder 63. As the outer mid-section 22 moves forward bell crank 58 moves out of contact with actuator 103 that maintains locking pin 52 retracted, and springs 54 move the pin upwardly but by this time the roller 55 on the top of the locking pin has moved forwardly of the edge of opening 57 and contacts the bottom surface of fly section 23 and rolls along the same during extension of the outer mid-section 22. With the valve 105 in the intermediate latching plunger extend position, hydraulic pressure is removed from lines 117,118 and 126, the spool valve 116 moves to the left as shown in FIG. 4, and the locking pin retract cylinder spring 102 forces fluid back out of the cylinder 100 which is bled back to the reservoir 106. Movement of the roller 72 downwardly from cam 80 makes no difference at this time as latching plunger 33 is still extended when outer mid-section 22 is extended with cylinder 63, as shown in FIG. 5B.

The boom is now in the position shown in FIG. 5B during the retraction operation. Control valve 105 is placed in the normal operating position shown in FIG. 4 which is the position to retract latching plunger 33. Retraction takes place, as previously described, indicator light 123 goes out, cylinder 63 is retracted and the boom is again in the position of FIG. 5A where fly section 23 can be locked in place to the outer mid-section 22 by a manual pin, not shown, for transit.

It may now be seen that the described hydraulic circuit constitutes an interlock between the latching plunger 33 and locking pin 52. A first interlock function is that whenever the plunger actuator 73 for valve 81 is between the two cams 80 as shown in FIG. 4, the latching plunger 33 cannot be hydraulically operated and retracted. The second interlock function is the following. Whenever the latching plunger 33 is not engaged with latch bar 48, locking pin retract cylinder 100 cannot be operated hydraulically against the force of spring 102 to turn bell crank 58 and retract locking pin 52. Thus, at all times, one of the elements 33 or 52 will be engaged with the fly section 23 to secure it, until it is retracted into the outer mid-section 22 and held by cylinder 63 and rod 64. The hydraulic circuit interlock forms a very important part of the invention without which the remote operation of the elements 33 and 52 would not be feasible for safety reasons, and without which the manual fly section could not be extended and retracted when the boom is at an elevated angle.

The terms and expressions which have been employed herein are used as terms of description and not of limitation, and there is no intention, in the use of such terms and expressions, of excluding any equivalents of the features shown and described or portions thereof but is is recognized that various modifications are possible within the scope of the invention claimed.

We claim:

1. In a telescoping boom which includes a base section and a manual fly section, a first extension and retraction power means connected between the base section and one telescoping section of the boom and extending into the interior of the manual fly section, a first latching element on said first power means, a second latching element on the manual fly section adapted to engage automatically with the first latching element responsive to extension or retraction of the manual fly section relative to the first power means, a second extension and retraction power means connected between two telescoping sections of the boom, a locking pin for the manual fly section on the telescoping section which immediately surrounds the manual fly section, the manual fly section having a coacting receiver for the locking pin with which the locking pin engages automatically responsive to relative movement between the manual fly section and the telescoping section immediately surrounding it, and remote power means for selectively disengaging the latching element on the first power means from the second latching element while the locking pin is engaged with said receiver and viceversa, said remote power means including a pressure fluid circuit forming a safety interlock between the first latching element and locking pin assuring that one will be engaged while the other is disengaged in the use of the manual fly section, said first latching element comprising an element yieldingly biased toward engagement with the second latching element and said locking pin being yieldingly biased toward engagement with said receiver, said pressure fluid circuit including means to cause selective disengagement of the first latching element and locking pin from the second latching element and said receiver respectively, and spaced actuator elements on said second extension and retraction power means, and a check valve forming part of the fluid circuit having an actuator in the path of movement of the spaced actuator elements and controlling the disengagement of said first latching element from the second latching element.

2. In a telescoping boom as defined in claim 1, and said remote power means additionally including an indicator which is activated and de-activated by pressure in said fluid circuit, said indicator being activated when said first latching element is engaged with the second latching element and being de-activated when such latching elements are disengaged.

3. In a telescoping boom as defined in claim 1, and the first latching element being a spring biased plunger element, a housing and guiding means for said plunger element having a pressure fluid chamber in communication with said check valve whereby the check valve when opened can deliver pressure fluid to said chamber to retract said plunger element and disengage it from said second latching element, said check valve being a normally closed valve in said pressure fluid circuit.

4. In a telescoping boom as defined in claim 3, and a pressure fluid operated indicator in said pressure fluid circuit for indicating engagement of said plunger element with said second latching element, and a normally open check valve in the pressure fluid circuit in communication with said chamber and controlling the activation of said indicator, extension of said plunger element by spring pressure causing closing of said normally open check valve to thereby activate said indicator.

5. In a telescoping boom as defined in claim 4, and a pressure fluid operated locking pin retract means in said pressure fluid circuit operable to retract and disengage the locking pin from said coacting receiver when the spring biased plunger element is engaged with the second latching element.

6. In a telescoping boom as defined in claim 5, and said locking pin retract means comprising a pressure fluid retract cylinder having a projecting actuator element on the piston of such cylinder, and a mechanical lever device in the path of movement of the projecting actuator element and being connected with the biased locking pin and retracting the locking pin in response to engagement by the projecting actuator element.

7. In a telescoping boom as defined in claim 6, and a multi-position control valve in said pressure fluid circuit having a latching element retract position, a latching element extension position and a locking pin retract position, the control valve when in the latching element retract position having pressure fluid communication with the normally closed check valve, and when in the locking pin retract position having pressure fluid communication with the normally open check valve.

8. In a telescoping boom as defined in claim 7, said pressure fluid circuit additionally comprising check valves which isolate said indicator from the normally open check valve to build up pressure in the circuit on one side of the indicator, and additional check valve means in the circuit on the other side of the indicator to build up equalizing pressure on such other side to activate the indicator when the normally open check valve closes in response to extension and engagement of said plunger element.

9. In a telescoping boom as defined in claim 1, and said last-named means including a pair of spaced cams on said second extension and retraction power means, a yieldingly biased valve actuator in the path of movement of said cams and adapted to be displaced to a valve opening position by contact with either cam, a normally closed check valve which opens in response to displacement of the yieldingly biased valve actuator, and said valve being in pressure fluid communication with a chamber of the first latching element, the first latching element having a surface in said chamber acted on by pressure fluid to retract the first latching element from engagement with the second latching element.

10. In a telescoping boom as defined in claim 9, and a normally open check valve which closes in response to extension and engagement of the first latching element with the second latching element, and a mechanical link between the first latching element and the normally open check valve operable to close such check valve in response to extension of the first latching element.

11. In a telescoping boom as defined in claim 9, and means in said pressure fluid circuit forming pressure fluid communication between the normally closed and normally open check valves and between such check valves and said chamber of the first latching element.

12. In a telescoping boom which includes at least an inner section, a mid-section and a manual fly section, means connected to at least the inner section and extending into the interior of the manual fly section when retracted, a first fluid powered latching element on said means, a second latching element on the manual fly section adapted to engage automatically with the first fluid powered latching element responsive to extension or retraction of the manual fly section relative to said means, an extension and retraction power means connected between the telescoping mid-section and inner section of the boom, a locking pin for the manual fly section on the telescoping mid-section which immediately surrounds the manual fly section, the manual fly section havng a coacting receiver for the locking pin with which the locking pin engages automatically responsive to relative movement between the manual fly section and the telescoping mid-section, and remote power means operatively connected to the first fluid powered latching element and the locking pin for selectively disengaging the fluid powered latching element on said means from the second latching element while the locking pin is engaged with said receiver and vice-versa, said remote fluid power means including a safety interlock circuit having operable fluid valve means connected between the first latching element and locking pin assuring that one will be engaged while the other is disengaged in the use of the manual fly section.

* * * * *